United States Patent [19]

Herbstman et al.

[11] 4,207,079

[45] Jun. 10, 1980

[54] PRIMARY ALIPHATIC HYDROCARBON AMINO ALKYLENE-SUBSTITUTED ASPARAGINE AND A MOTOR FUEL COMPOSITION CONTAINING SAME

[75] Inventors: Sheldon Herbstman, Spring Valley; Peter Dorn, Lagrangeville, both of N.Y.

[73] Assignee: Texaco Inc., White Plains, N.Y.

[21] Appl. No.: 31,557

[22] Filed: Apr. 19, 1979

[51] Int. Cl.[2] ..... C10L 122

[52] U.S. Cl. ..... 44/71; 260/501.11; 252/392

[58] Field of Search ..... 44/71; 260/501.11; 252/396

[56] References Cited

U.S. PATENT DOCUMENTS

| | | | |
|---|---|---|---|
| 3,773,479 | 11/1973 | Dorn et al. | 44/71 |
| 3,980,448 | 9/1976 | Haemmerle et al. | 252/394 |
| 4,018,702 | 4/1977 | Boffardi et al. | 252/392 |
| 4,047,900 | 9/1977 | Dorn et al. | 44/71 |

*Primary Examiner*—Patrick Garvin
*Assistant Examiner*—Y. Harris-Smith
*Attorney, Agent, or Firm*—Carl G. Ries; Robert A. Kulason; James J. O'Loughlin

[57] ABSTRACT

A primary aliphatic hydrocarbon amino alkylene-substituted asparagine represented by the formula:

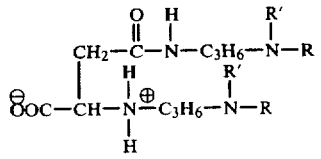

in which R is a primary aliphatic hydrocarbon radical having from about 6 to 30 carbon atoms, R′ is hydrogen or a methyl radical is provided and a motor fuel composition containing same.

16 Claims, No Drawings

PRIMARY ALIPHATIC HYDROCARBON AMINO ALKYLENE-SUBSTITUTED ASPARAGINE AND A MOTOR FUEL COMPOSITION CONTAINING SAME

BACKGROUND OF THE INVENTION

1. Field of the Invention

Gasoline compositions are highly refined products. Despite this, they contain minor amounts of impurities which can promote corrosion during the period that the fuel is transported in bulk or held in storage. Corrosion can also occur in the fuel tank, fuel lines and carburetor of a motor vehicle. As a result, a commercial motor fuel composition must contain a corrosion inhibitor to inhibit or prevent corrosion.

Internal combustion engine design is undergoing changes to meet new standards for engine exhaust gas emissions. One design change involves the feeding of blow-by gases from the crankcase zone of the engine into the intake air supply to the carburetor rather than venting these gases to the atmosphere as in the past. Another change involves recycling part of the exhaust gases to the combustion zone of the engine in order to minimize objectionable emissions. Both the blow-by gases from the crankcase zone and the recycled exhaust gases contain significant amounts of deposit-forming substances which promote the formation of deposits in and around the throttle plate area of the carburetor. These deposits restrict the flow of air through the carburetor at idle and at low speeds so that an overrich fuel mixture results. This condition produces rough engine idling or stalling causing an increase in the amount of polluting exhaust gas emissions, which the engine design changes were intended to overcome, and decreasing fuel efficiency.

Certain N-alkyl-alkylene diamine compounds, as represented by N-oleyl-1,3-diaminopropane, are known to give carburetor detergency properties to gasoline. These additives, however, do not impart corrosion inhibiting properties to gasoline. As a result, a motor fuel containing an N-alkyl-alkylene diamine must be modified or formulated with an additional additive in order to have the necessary corrosion inhibiting properties for marketability.

2. Description of the Prior Art

U.S. Pat. No. 3,773,479 discloses a motor fuel composition containing an alkyl-substituted asparagine having the formula:

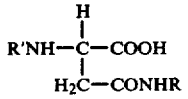

in which R and R' each represent secondary or tertiary alkyl radicals having from 7 to 20 carbon atoms. The corresponding compounds in which R and R' are straight chain radicals are too insoluble in gasoline to be effective as an additive.

A copending application disclosing a motor fuel composition containing the reaction product of an aliphatic ether monoamine and maleic anhydride was filed on Mar. 27, 1978 under Ser. No. 890,104, now U.S. Pat. No. 4,144,034.

SUMMARY OF THE INVENTION

A novel primary aliphatic hydrocarbon aminoalkylene-substituted asparagine compound is provided which is useful as a multifunctional additive when employed in a liquid hydrocarbon fuel for an internal combustion engine. The compound, which is produced by reacting about two moles of an N-primary alkyl-alkylene diamine with a mole of maleic anhydride to produce a compound characterized by having a plurality of amino groups in an essentially straight chain primary alkyl hydrocarbon radical, exhibits surprising corrosion inhibiting properties as well as essential carburetor detergency properties when employed in gasoline. This finding of multifunctionality is surprising in itself and also contrasts with the discovery of U.S. Pat. No. 3,773,479 which discloses that there is selectivity in the effectiveness of derivatives of maleic anhydride.

The fuel composition of the invention prevents or reduces corrosion problems during the transportation, storage and the final use of the product. The gasoline of the invention also has highly effective carburetor detergency properties. When a gasoline of the invention is employed in a carburetor which already has a substantial build-up of deposits from prior operations, a severe test of the carburetor detergency property of a fuel composition, this motor fuel is effective for removing substantial amounts of the preformed deposits.

DESCRIPTION OF THE PREFERRED EMBODIMENTS

The primary aliphatic hydrocarbon amino alkylenesubstituted asparagine of the invention is represented by the formula:

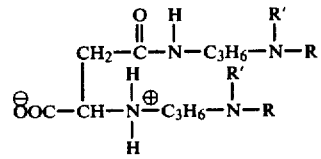

in which R represents a primary aliphatic hydrocarbon radical having from 6 to 30 carbon atoms and R' is hydrogen or a methyl radical. A preferred compound of the invention is one in which R is a straight chain primary aliphatic hydrocarbon radical and R' is hydrogen. A particularly preferred compound is one formed from a straight chain aliphatic hydrocarbon radical having from 16 to 20 carbon atoms and 1,3-propane diamine.

The preferred compound is represented by the formula:

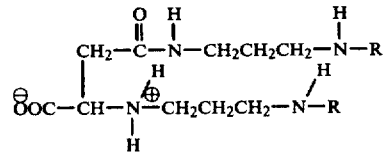

in which R is a primary aliphatic hydrocarbon radical having from 16 to 20 carbon atoms.

The novel compound of the invention is prepared by reacting an N-primary-alkyl-alkylene diamine with maleic anhydride. Approximately two moles of the N-primary alkylalkylene diamine are reacted with a mole of maleic anhydride at a temperature ranging from about room temperature up to about 110° C. maximum, preferably from about 60° to 100° C. The upper temperature limit in the preparation of the additive is critical. Higher temperatures especially above 110° C. cause the formation of succinimide compounds which have essentially no corrosion inhibiting properties for a motor fuel composition.

The N-primary alkyl-alkylene diamine reactant is represented by the formula:

$$R, R'—N—C_3H_6—NH_2$$

in which R is a primary aliphatic hydrocarbon radical having from about 6 to 30 carbon atoms and R' is hydrogen or a methyl radical. Preferred N-primary alkyl-alkylene diamines are those in which R is a straight chain primary alkyl radical and R' is hydrogen. As employed herein the term N-alkyl-alkylene diamine covers both N-monoalkyl-alkylene diamine and the N-dialkyl-alkylene diamine structure when R' is a methyl radical.

The most preferred N-alkyl-alkylene diamines are represented by the formula:

$$R—NH—CH_2CH_2—CH_2—NH_2$$

in which R is a straight chain primary alkyl aliphatic hydrocarbon radical having from 16 to 20 carbon atoms.

Examples of suitable N-alkyl-alkylene diamines include N-oleyl-1,3-propane diamine, N-lauryl-1,3-propane diamine, N-stearyl-1,3-propane diamine and N-dodecyl-1,3-propane diamine.

This reaction is illustrated by the following formulas:

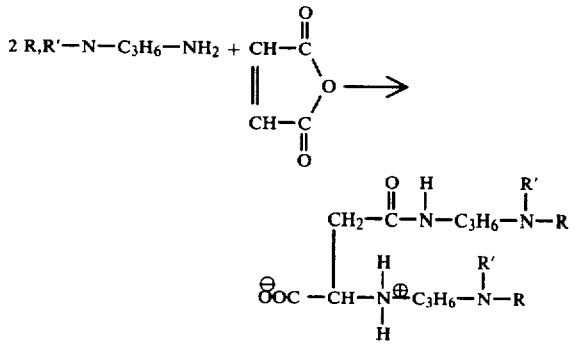

in which R and R' have the value noted above.

Examples of specific compounds of the invention producted in this reaction which are effective as multifunctional gasoline additives include the following:

N,N'-di-(3-n-oleylamino-1-propyl)asparagine
N,N'-di-(3-n-dodecylamino-1-propyl)asparagine
N,N'-di-(3-n-octylamino-1-propyl)asparagine
N,N'-di-(3-stearylamino-1-propyl)asparagine
N,N'-di-(3-decylamino-1-propyl)asparagine
N,N'-di-(3-laurylamino-1-propyl)asparagine
N,N'-di-(3-behenylamino-1-propyl)asparagine It will be appreciated that by-products and/or impurities can be co-produced along with the compound of the invention in this reaction. The desired additive compounds can be readily recovered from the reaction product by known methods. However, it is feasible and economical to employ the prescribed compounds as produced without separation or purification.

The following examples illustrate methods for preparing the additive of the invention:

EXAMPLE I 63.4 grams of maleic anhydride (0.647 mole) are suspended in 423.4 grams mineral oil having an SUS at 100° F. of 100 and with stirring and nitrogen purge is heated at 100° C. for 1 hour. N-oleyl-1,3-propane diamine (Duomeen-O, 460 grams, 1.347 mole) in 100 grams of mineral oil similar to the above is introduced at 100° C. over 1 hour. The reaction is heated at 100° C. an additional 2 hours and then filtered hot.

Analysis of the 50 percent oil solution of the additive was as follows:

| | |
|---|---|
| N, wt.% | 3.5 |
| Total Acid Number | 27.4 |
| Total Base Number | 106.5 |

EXAMPLE II 63.4 grams (0.647 moles) of maleic anhydride were added to 480 milliliters of xylene and heated to about 100° C. 460 grams (1.349 moles) of N-oleyl-1,3-propane diamine were added to the xylene solution of the maleic anhydride forming a reaction mixture. This mixture was continuously heated at about 100° C. for 2 hours. It was then cooled to room temperature and stripped free of xylene. A yield of 540 grams or 99 percent was obtained having the following analysis:

| | |
|---|---|
| TBN | 239 |
| TAN | 56 |
| % N | 6.2 |

EXAMPLE III 13.2 grams (0.137 moles) of maleic anhydride were suspended in 50 grams of mineral oil in a closed reactor. The reactor was purged with nitrogen and the mixture stirred with heating at 100° C. for 1 hour. 50 grams (0.269 moles) of N-1(n-octyl)-1,3-propane diamine in 13.2 grams of mineral oil was introduced into the maleic anhydride mixture at 100° C. over a 1 hour period. The reaction mixture was heated at 100° C. for an additional 2 hours and then filtered hot.

Analysis of the oil solution of the additive was as follows:

N, wt. %: 5.1

EXAMPLE IV 49 grams (0.51 moles) of maleic anhydride were suspended in 165.3 grams of mineral oil. The reactor was purged with nitrogen and the mixture stirred with heating at 100° C. for 1 hour. 136.3 grams of N-1(sec. $C_{14}$–$C_{16}$ alkyl)-1,3-propane diamine was mixed with 20 grams of mineral oil. This solution was introduced into the maleic anhydride solution at 100° C. over a 1 hour period. The reaction mixture was heated 100° C. for an additional 1 hours and then the reaction product was filtered hot.

Analysis of the oil solution of the additive was as follows:

N, wt. %: 2.2

The base fuel, which is useful for employing the additive of the invention, is a mixture of hydrocarbons boiling in the gasoline boiling range. This base fuel may consist of straight-chain or branched-chain paraffins, cycloparaffins, olefins, and aromatic hydrocarbons, and any mixture of these. The base fuel can be derived from straight-run naphtha, polymer gasoline, natural gasoline or from catalytically reformed stocks and boils in the range from about 80° to 450° F. The composition and the octane level of the base fuel are not critical and any conventional motor fuel base can be employed in the practice of this invention.

In general, the additive of the invention is added to the base fuel in a minor amount, i.e., an amount effective to provide both corrosion inhibition and carburetor detergency to the fuel composition. The additive is effective in an amount ranging from about 0.0002 to 0.2 weight percent based on the total fuel composition. An amount of the neat additive ranging from about 0.001 to 0.01 weight percent is preferred, with an amount from about 0.001 to 0.003 being particularly preferred, the latter amounts corresponding to about 3 to 8 PTB (pounds of additive per 1000 barrels of gasoline) respectively.

The fuel composition of the invention may contain any of the additives normally employed in a motor fuel. For example, the base fuel may be blended with an anti-knock compound, such as a methyl-cyclopentadienyl manganese tricarbonyl or tetraalkyl lead compound, including tetraethyl lead, tetramethyl lead, tetrabutyl lead, and chemical and physical mixtures thereof, generally in a concentration from about 0.025 to 4.0 cc. per gallon of gasoline. The tetraethyl lead mixture commercially available for automotive use contains an ethylene chloride-ethylene bromide mixture as a scavenger for removing lead from the combustion chamber in the form of a volatile lead halide.

Gasoline blends were prepared from a typical base fuel mixed with specified amounts of the prescribed fuel additive of the invention. These fuels were then tested to determine the effectiveness of the additive in gasoline together with comparison fuels in the following performance tests.

The base fuel employed with the additive of the invention in the following examples was an unleaded grade gasoline having a Research Octane Number of about 93. This gasoline consisted of about 32 percent aromatic hydrocarbons, 8 percent olefinic hydrocarbons and 60 percent paraffinic hydrocarbons and boiled in the range from 88° F. to 373° F.

The rust inhibiting properties of fuel compositions of the invention was determined in the NACE Test (National Association of Corrosion Engineers) which is a modification of ASTM Rust Test D-665-60 Procedure A. In the NACE Test, a steel spindle is polished with non-waterproof fine emery cloth. The spindle is immersed in a mixture containing 300 cc fuel and 30 cc distilled water and is rotated at 100° F. for 3.5 hours. The spindle is then rated visually to determine the amount of rust formation. A passing result is an average of less than 5% rust.

The results of this test are set forth in Table I below:

TABLE I

NACE RUST TEST

| Run | Additive | Concentration, PTB[1] | Percent Rust |
|---|---|---|---|
| 1 | N-oleyl-1,3-propane diamine (Duomeen O) | 2.5 | 50–100 |
| 2 | N-oleyl-1,3-propane diamine (Duomeen O) | 5.0 | 50–100 |
| 3 | N-oleyl-1,3-propane diamine (Duomeen O) | 10.0 | 50–100 |
| 4 | Example I (in a 50% oil solution) | 5.0 | 1–5 |
| 5 | Example I (in a 50% oil solution) | 10.0 | 1–5 |
| 6 | Example I (in a 50% oil solution) | 20.0 | Trace to 1 |
| 7 | Example IV (in a 50% oil solution) | 10.0 | 50–100 |
| 8 | Commercial Rust Inhibitor | 2.5 | 50–100 |
| 9 | Commercial Rust Inhibitor | 5.0 | 1–5 |

1 *PTB = pounds of additive per 1000 barrels of fuel (unleaded gasoline).*

The foregoing data shows that the novel reaction product of the invention was highly effective as a corrosion inhibitor in the NACE Test even at the lowest concentrations. This result is in marked contrast to the results obtained using N-oleyl-1,3-propane diamine and are superior to the results obtained using a commercial rust inhibitor.

The additive of the invention was tested as a carburetor detergent in the Chevrolet Carburetor Detergency Test. This test is run on a Chevrolet V-8 engine mounted on a test stand using a modified four barrel carburetor. The two secondary barrels of the carburetor are sealed and the feed to each of the primary barrels arranged so that an additive fuel can be run in one barrel and the base fuel run in the other. The primary carburetor barrels were also modified so that they had removable aluminum inserts in the throttle plate area in order that deposits form on the inserts in this area could be conveniently weighed.

In the procedure designed to determine the effectiveness of an additive fuel to remove preformed deposits in the carburetor, the engine is run for a period of time usually 24 to 48 hours using the base fuel as the feed to both barrels with engine blow-by circulated to an inlet in the carburetor body. The weight of the deposits on both sleeves is determined and recorded. The engine is then cycled for 24 additional hours with a suitable reference fuel being fed to one barrel, additive fuel to the other and blow-by to the inlet in the carburetor body. The inserts are then removed from the carburetor and weighed to determine the difference between the performance of the additive and reference fuels in removing the preformed deposits. After the aluminum inserts are cleaned, they are replaced in the carburetor and the process repeated with the fuels reversed in the carburetor to minimize differences in fuel distribution and barrel construction. The deposit weights in the two runs are averaged and the effectiveness of the fuel composition of the invention is compared to the reference fuel which contains an effective detergent additive. The difference in effectiveness is expressed in percent.

The carburetor detergency test results obtained with the fuel composition of the invention in comparison to the base fuel and to two commercial detergent fuel compositions was obtained at the same detergent additive concentration, i.e. 20 PTB. The comparison commercial fuels are identified as Reference Fuel A and Reference Fuel B. The results are set forth in the table below:

TABLE II

CHEVROLET CARBURETOR DETERGENCY TEST

| Run | Additive Fuel Composition | % Wash Down (Removal) of Preformed Deposits[1] |
|---|---|---|
| 1 | Base Fuel | +10[2] |
| 2 | Reference Fuel A | −62 |
| 3 | Reference Fuel B | −66 |
| 4 | Base Fuel + 20 PTB Ex. I | −80 (Check −86) |

[1]Built up with base fuel.
PTB = Pounds of Additive per 1000 Barrels of fuel based upon 100% active material (additive neat). [2] "+" Denotes a deposit build-up.

The foregoing tests show that the fuel composition of the invention was highly effective in the Chevrolet Carburetor Detergency Test with results superior to two commercial detergent fuel compositions.

The effect on carburetor detergency of the fuel compositions of the invention was also determined in a second carburetor detergency test, namely, the Buick Carburetor Detergency Test. This test is run on a Buick 350 CID V-8 engine equipped with a two barrel carburetor. The engine is mounted on a test stand and has operating EGR and PCV systems. The test cycle, shown in Table II, is representative of normal road operation. Approximately 300 gallons of fuel and three quarts of oil are required for each run.

Prior to each run the carburetor is completely reconditioned. Upon completion of the run the throttle plate deposits are visually rated according to a CRC Varnish rating scale (Throttle Plate Merit Rating) where 1 describes heavy deposits on the throttle plate and 10 a completely clean plate.

TABLE II

1973 BUICK CARBURETOR DETERGENCY TEST OPERATING CONDITIONS

| | Stage I | Stage II | Stage III |
|---|---|---|---|
| Duration, hours | 1 | 3 | 1 |
| Speed, r.p.m. | 650 ± 25 | 1500 ± 25 | 2000 ± 25 |
| Torque, ft.-lbs. | 0 | 80 ± 2 | 108 ± 2 |
| Water Out, °F. | 205 ± 5 | 205 ± 5 | 205 ± 5 |
| Carburetor Air, °F. | 140 ± 5 | 140 ± 5 | 140 ± 5 |
| Exhaust Back Pres. in Hg | — | 0.7 ± 0.1 | — |
| Man. Vac. In. Hg | — | 15.8 | 14.2 |
| Fuel Flow, lbs/hr | 0.7 | 7.5 | 12.0 |
| Test Duration, 120 hours | | | |

The Base Fuel employed for testing the additive of the invention was the same unleaded gasoline composition disclosed above. The results of this test are set forth in the following Table:

TABLE III

BUICK CARBURETOR DETERGENCY TEST

| Run | Fuel Composition | Additive Concentration PTB | Carburetor Rating Plates/Below Plates/Average |
|---|---|---|---|
| 1 | Base Fuel | — | 2.4/3.9/(3.2) |
| 2 | Reference Fuel A[3] | 20 | 6.8/7.5/(7.2) |
| | | " | ck 7.8/7.8/(7.8) |
| 3 | Reference Fuel B[1] | 7.5 | 5.0/5.3/(5.2) |
| 4 | Base Fuel + Ex. I | 15[2] | 9.3/9.1 (9.2) |
| | | " | 8.9/8.7 (8.8) |

TABLE III-continued

BUICK CARBURETOR DETERGENCY TEST

| Run | Fuel Composition | Additive Concentration PTB | Carburetor Rating Plates/Below Plates/Average |
|---|---|---|---|
| | | " | 9.1/8.9 (9.0) |

[1]Contains 7.5 PTB of a commercial fuel detergent
[2]Concentration based on a 50 percent oil solution of the additive.
[3]An effective carburetor detergent.

The foregoing results demonstrate that the novel fuel composition of the invention was unusually effective for maintaining cleanliness of the throttle plates as measured by the CRC Varnish rating scale in the Buick Carburetor Detergency Test.

The foregoing tests show that the prescribed novel additives of the invention are outstandingly effective multifunctional additives for a motor fuel composition and that the blended gasoline compositions containing same possess a high level of corrosion inhibition and carburetor detergency properties.

We claim:

1. The compound represented by the formula:

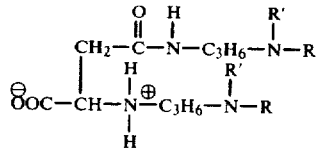

in which R is a primary aliphatic hydrocarbon radical having from about 6 to 30 carbon atoms and R' is hydrogen or a methyl radical.

2. The compound represented by the formula:

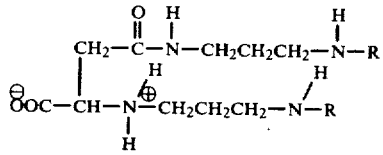

in which R is a straight chain primary aliphatic hydrocarbon radical having from 16 to 20 carbon atoms.

3. N,N'-di-(3-n-oleylamino-1-propyl) asparagine.
4. N,N'-di-(3-n-dodecylamino-1-propyl) asparagine.
5. N,N'-di-(3-n-octylamino-1-propyl) asparagine.
6. N,N'-di-(3-stearylamino-1-propyl) asparagine.
7. N,N'-di-(3-laurylamino-1-propyl) asparagine.
8. A motor fuel composition comprising a mixture of hydrocarbons in the gasoline boiling range containing from about 0.0002 to 0.2 weight percent of an additive represented by the formula:

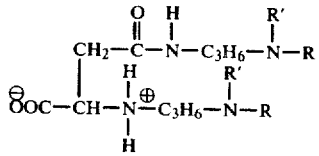

in which R is a primary aliphatic hydrocarbon radical having from about 6 to 30 carbon atoms and R' is hydrogen or a methyl radical.

9. A motor fuel composition according to claim 8 in which said compound is represented by the formula:

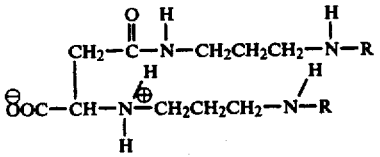

in which R is a straight chain primary aliphatic hydrocarbon radical having from 16 to 20 carbon atoms.

10. A motor fuel composition according to claim 8 in which said compound is N,N'-di-(3-n-oleylamino-1-propyl) asparagine.

11. A motor fuel composition according to claim 8 in which said compound is N,N'-di-(3-n-dodecylamino-1-propyl) asparagine.

12. A motor fuel composition according to claim 8 in which said compound is N,N'-di-(3-n-octylamino-1-propyl) asparagine.

13. A motor fuel composition according to claim 8 in which said compound is N,N'-di-(3-stearylamino-1-propyl) asparagine.

14. A motor fuel composition according to claim 8 in which said compound is N,N'-di-(3-laurylamino-1-propyl) asparagine.

15. A motor fuel composition according to claim 8 in which said additive is a mixture of N,N'-di-(3-stearylamino-1-propyl)- and N,N'-di-(3-oleylamino-1-propyl)-asparagines.

16. A motor fuel composition according to claim 8 containing from about 0.001 to 0.01 weight percent of said additive.

* * * * *